United States Patent [19]

Sick

[11] 3,937,038

[45] Feb. 10, 1976

[54] DEVICE FOR THE CONTINUOUS MONITORING OF THE CONDITION OF THE NEEDLE HEADS ON A CIRCULAR KNITTING MACHINE

[75] Inventor: Erwin Sick, Icking, Germany

[73] Assignee: Firma Erwin Sick Optik-Elektronik, Waldkirch, Germany

[22] Filed: June 1, 1973

[21] Appl. No.: 366,022

[30] Foreign Application Priority Data

June 15, 1972 Germany ..... 2229232

[52] U.S. Cl. ..... 66/157; 356/200; 356/237; 250/224; 66/165

[51] Int. Cl.[2] ..... D04B 35/10

[58] Field of Search ..... 66/161, 166, 165, 157; 356/200, 237, 238; 250/222, 222 R, 224

[56] References Cited

UNITED STATES PATENTS

| | | | |
|---|---|---|---|
| 3,345,835 | 10/1967 | Nickell et al. | 66/166 |
| 3,490,253 | 1/1970 | Sick et al. | 66/166 |
| 3,529,445 | 9/1970 | Brose | 66/165 |
| 3,575,515 | 4/1971 | Fertig | 66/161 |
| 3,591,291 | 7/1971 | Greer | 356/237 |
| 3,628,030 | 12/1971 | Fertig et al. | 250/222 |
| 3,657,727 | 4/1972 | Blevins | 66/166 UX |

FOREIGN PATENTS OR APPLICATIONS

| | | | |
|---|---|---|---|
| 991,151 | 10/1951 | France | 356/237 |

OTHER PUBLICATIONS

Brose, P. Fault Detection On Circular Knitting Machines, In the Hosiery Trade Journal. 76(906): pp. 88–92, June, 1969.

*Primary Examiner*—W. C. Reynolds
*Assistant Examiner*—A. M. Falik

[57] ABSTRACT

Apparatus for the continuous monitoring of the condition of the needle heads of a circular knitting machine which move past a predetermined point one after the other at a definite frequency comprising an illuminating component for producing a light spot in the form of a line situated in the plane of an illuminated needle head without light projecting laterally beyond it, said light spot being projected into an aperture substantially the size of the image of the light spot, a photoreceiver disposed behind said aperture and adapted to emit an electrical pulse signal in proportion to the luminous flux passing through the aperture, and a threshold value electronic device for receiving said signal, which when a pulse falls below a predetermined value and/or when there is a change in the predetermined time spacing of two successive pulses, delivers a warning signal.

11 Claims, 6 Drawing Figures

DEVICE FOR THE CONTINUOUS MONITORING OF THE CONDITION OF THE NEEDLE HEADS ON A CIRCULAR KNITTING MACHINE

BACKGROUND OF THE INVENTION

The invention relates to a device for the continuous monitoring of the condition of an uninterrupted series of identical, light-reflecting objects which move past a predetermined point one after the other, at a definite frequency, in particular the needle heads on a circular knitting machine.

A device of this kind is of particular importance on a circular knitting machine because if a needle head bends or breaks and the machine continues to run, it can result in at least a substantial portion of the material produced to be regarded as seconds or even rejected.

the object of the invention therefore consists in providing a compact device of the type described above which can be produced economically and is reliable in operation, by means of which it is possible, if a needle bends or breaks, to set off at once an alarm signal which can be utilized, for example, to stop the circular knitting machine immediately. Although the preferred field of application for the device according to the invention is with circular knitting machines, the device can, however, be used anywhere where similar problems arise.

SUMMARY OF THE INVENTION

As a solution of the problem according to the invention it is provided that a spot of light is produced at a certain point on each object, especially a needle head, not projecting beyond it laterally, which is projected into an aperture, substantially the size of the image of the light spot, behind which is disposed a photo-receiver, and that the electric pulse signal emitted by the photo-receiver in proportion to the luminous flux passing through the aperture is applied to a threshold value electronic device which, when a pulse falls below a predetermined value, and/or when there is a change in the predetermined time spacing of two successive pulses, delivers a warning signal. A description and circuitry of a threshold value electronic device will be found in U.S. Pat. No. 3,529,445 to Brose dated Sept. 22, 1970 in FIG. 4, element 14. Especially with the aperture being in the preferred form of a slit, it is possible according to the invention to obtain such a small depth of focus that on the one hand practically only reflected light coming from the needle heads reaches the photo-receiver and, on the other hand, a warning signal is given on even a very slight deviation of a needle head from the focal plane. The evaluating electronic system is of a particularly simple construction if it is only required to detect broken or badly bent needle hooks which practically cause the pulse to disappear. However, the electronic system may also be constructed so that even slightly bent needle hooks and laterally bent needles are detected. Even with this latter improved construction the optical arrangement is the same. Even the simpler form of construction which responds only to actually broken needles is of great importance practically because in circular knitting machines the incidence of breakage of needle hooks is a substantially large percent of all causes of breakdown. With the improved construction of the electronic system an even greater percent of breakdown causes would be detected, that is the laterally bent and drawn up needles, so that in practice the majority of all possible causes of breakdown can thus be detected promptly and remedied.

In a preferred form of construction the light spot takes the shape of a line situated in the plane of the respective needle head. This makes allowance for a larger area of the surface of the needle heads to participate in reflection and for the purpose of adjustment the light beam may project somewhat beyond the needle heads.

It is preferable, for monitoring the cylinder needles and the dial needles of a circular knitting machine, to employ a separate device in each case. Thus, for one machine, preferably two to three needle sensing devices will be employed in according with the invention, this being easily possible in view of their compact construction and economic production.

Since the needles on a circular knitting machine are equidistant and rotate in a circle at a constant speed and the needle sensor is mounted in a fixed position, the photo-receiver picks up periodic light pulses and these are then evaluated in the threshold value electronic system.

In another advantageous form of construction an illuminating component and a receiving component are disposed side by side in a housing. This gives a very compact construction. The same object is achieved by means of a housing consisting of a rectangular box, an end cover and a cylindrical tube.

The illuminating component conveniently comprises a light source, a condensing lens, a slit for producing a linear light spot, and focussing lenses. In this connection it is especially preferable for the focussing lenses disposed in the tube to consist of a semicircular lens taking up only half the tube cross-section and a round aspherical lens situated behind it taking up the entire tube cross-section. Here it is convenient if the coiled filament of the light source is imaged in the semicircular lens. This prevents any possible irregularities of the coiled filament of the light source from exerting a disturbing influence on the monitoring.

The focal point of the semicircular lens is conveniently situated in the slit so that the light beams emerging from the slit leave the lens parallel and thus are brought together at the focal point of the aspherical lens, which takes up the entire tube cross-section. Here, the focal point of the aspherical lens occupies the position of the needle head which is to be sensed.

In a further advantageous form of construction the receiving component comprises a photo-transistor acting as the photo-receiver, an aspherical lens, a slit and focussing lenses which focus the linear light spot in the aperture of the slit. Here the size of the slit determines the depth of focus of the system. If, with the transmission slit constant, the receiving slit is made bigger, then the depth of focus is likewise increased. In accordance with the invention the depth of focus is such that the circular knitting machine is not stopped for the normal fluctuations of the needle heads but only when the deflection of the needle heads exceeds the amount met with in normal operations.

The focussing lenses disposed in the receiving component likewise consist conveniently of a semicircular lens occupying only half the tube cross-section and the same aspherical lens located in front of it and also forming part of the illuminating component. Thus, according to the invention, a pupillary division takes place between the transmission component and the receiving component, but the terminal lens on the end is common to both beam paths. This gives a very compact and at the same time very effective optical construction.

The semicircular lenses are preferably of identical construction and disposed in the same cross-sectional plane of the tube. The optical axes of the semicircular lenses conveniently coincide with the optical axes of the illuminating component and the receiving component respectively, whereas the optical axis of the aspherical lens common to the illuminating component and the receiving component lies centrally between the optical axes of the illuminating component and the receiving component. In this way, while preserving well-defined optical imaging conditions, maximum advantage is taken of the cross-sectional space available in the tube.

The slits in the illuminating and the receiving components are advantageously parallel and situated in one plane. In this connection the two slits are preferably provided in one removable diaphragm. The advantage of this is that in the case of different applications it is always possible, by making the receiving slit in particular of an appropriate size, to select the optimum range of focal depth in advance.

The diaphragm is conveniently arranged so as to be movable perpendicular to the slits in their plane. By the provision of precisely dimensioned stops it is possible in this way, in spite of the interchangeability of the diaphragm, to ensure a very precise operational arrangement.

In order to substantially isolate the two beam paths from one another and to prevent stray light effects there is disposed, according to a further form of construction, at least inside the tube between the illuminating component and the receiving component, a partition wall extending as far as the lens located at the end of the tube. The wall also separates the two semicircular lenses from one another and these each then differ from the precisely semicircular by the amount of half the thickness of the partition wall. The essential point is that the lenses in question completely fill up the substantially semicircular space which is available between the partition wall and the wall of the tube.

In another advantageous form of construction the aspherical condensing lens is disposed in an axially adjustable mount. This permits precise adjustment during the assembling of the device.

The light source is accommodated advantageously in the box cover which can be adjusted transversely to the optical axis so that a precise preliminary adjustment of the coiled filament of the light source can also be achieved.

The photo-transistor is preferably cemented into a mount, together with the aspherical lens and an aspherical meniscus so that it can be prefabricated as a separate component and subsequently installed in the housing. This ensures a well-defined relationship between the assembled parts.

It is preferable, from both constructional and optical points of view, if the photo-transistor and the light source, on the one hand, and the aspherical lens and the condensing lens, on the other, are disposed side by side. The optical axis of the aspherical lens advantageously runs obliquely to the needle axis at the end of the tube and preferably at an angle of 45° to the needle axis. Moreover it is preferable if the light spot is produced in the region of the curve extending beyond the crown of the needle heads and preferably at about the 45° tangent.

This advantageous arrangement of the device on the circular knitting machine ensures an optimum response sensitivity.

BRIEF DESCRIPTION OF THE DRAWINGS

The invention will now be further described by way of example with reference to the accompanying drawing in which.

DESCRIPTION OF THE PREFERRED EMBODIMENT

Figure 1:
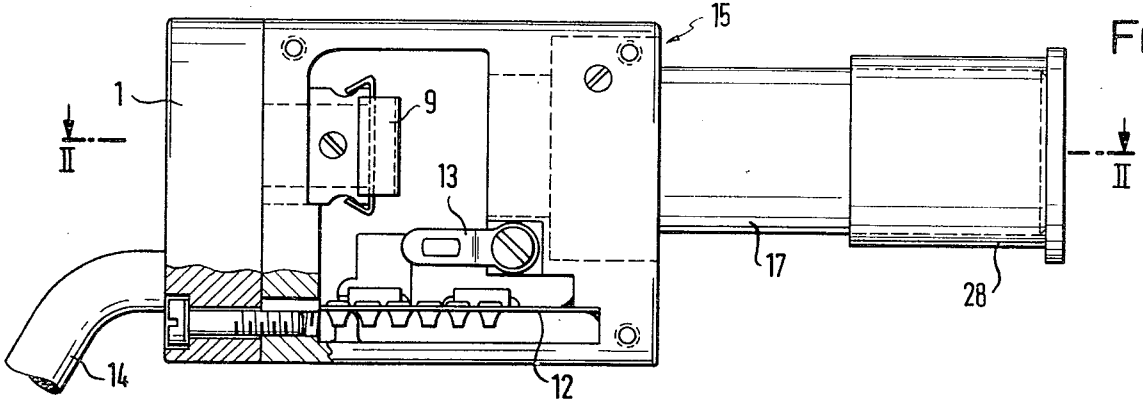
FIG. 1 is a partially cut away side elevation of a preferred form of construction of the device according to the invention.
Figure 2:
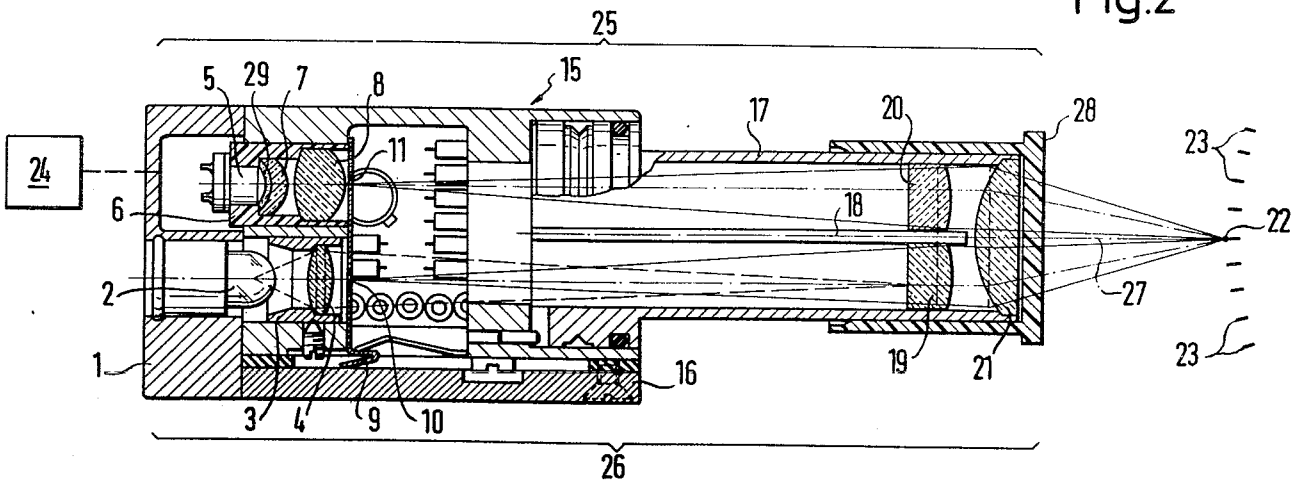
FIG. 2 is a section taken along the line II—II of FIG. 1.

As shown in FIGS. 1 and 2, the device according to the invention has a housing which consists of a tube 17 and a box 15 with removable covers 1 and 16. The tube 17 can be masked at its right-hand end by an opaque closing cap 28.

Disposed in the laterial adjustable end cover 1 as a light source is an incandescent lamp 2 behind which, in the box 15, is an adjustable mount 3 which carries a condensing lens 4. Immediately behind the condensing lens 4 is a diaphragm 9 which has, amongst other things, a slit 10 which is perpendicular to the plane of the drawing in FIG. 2.

In addition to the arrangement consisting of the incandescent lamp 2, the condensing lens 4 and the slit 10 there is a mount 6 in which are cemented a photo-transistor 5, an aspherical meniscus 7 and an aspherical lens 8. The mount itself is fixed rigidly in the box 15 of the housing. The aspherical lens 8 and the meniscus 7 ensure an optimum, full illumination of the photo-transistor. In order to improve the illumination, the interspace between the photo-transistor and the meniscus is filled up additionally with transparent cast resin 29.

Immediately in front of the aspherical lens 8, in the same diaphragm 9 in which the slit 10 is formed, is a further slit 11 running parallel with the slit 10. As can be seen best in FIG. 1, the diaphragm 9 is pushed on to a base in such a way that it can be removed.

Also disposed in the box 15, in accordance with the invention, are a pre-amplifier 12 and an earthing lug 13, at the positions shown. All the electrical connections are brought together and led out of the housing by means of a cable 14. The connection of the receiving optical system to the threshold electronic system 24 is shown in FIG. 2 by a broken line.

In the tube 17, in the middle, is a partition wall 18 extending longitudinally. Cemented on to the partition wall 18 in the right-hand portion, in accordance with the invention, are two identical, substantially semicircular lenses 19, 20. The external shape of these lenses is adapted to the free space, that is to say they are in the form of segments of circles. The optical axes of the lens 19, 20 are concentric with the optical axes of the condensing lens, or receiving optical system.

The tube 17 is terminated by an aspherical lens 21, the optical axis 27 of which lies between the abovementioned two optical axes.

As can be seen from FIG. 2 especially, the device according to the invention is thus subdivided into a receiving component 25 and an illuminating component 26. In this connection the aspherical lens 21 is common to both beam paths.

The incandescent lamp 2 illuminates the slit 10 by way of the condensing lens 4, this lens 4 being so constructed and disposed that the maximum amount of light strikes the lens 19 through the slit. Thus the coiled filament of the incandescent lamp 2 is imaged in the lens 19. Since the slit 10 lies at the focal point of the lens 19 the light leaves the lens 19 parallel, as shown in FIG. 2. The lens 21 gathers the parallel light at a point 22 which is passed by the needle heads 23 of the circular knitting machine.

Light is reflected from the needle heads, into the receiving component 25. Part of the reflected light is gathered by the lens 21 and rendered parallel. A portion of this parallel bundle is picked up by the partial lens 20 and imaged in the slit 11. The light passing through the slit or aperture 11 is gathered by the lenses 7, 8 and concentrated on the photo-transistor 5. The size of the slit 11 must be set precisely so that with the normal fluctuations of the needle heads 23 of a circular knitting machine there is no setting off of the threshold value electronic system but that this does happen in the event of deviations beyond the normal. In other words the range of the depth of focus at the point 22, which is determined by the width of the slit 11, is an essential factor in the functioning of the device according to the invention.

Figure 3:
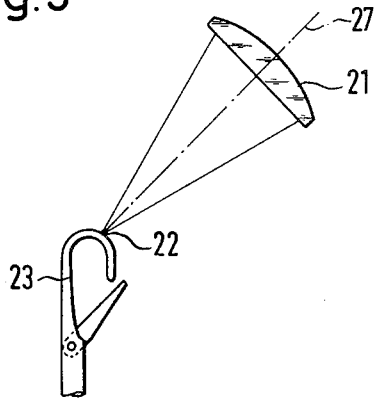
FIG. 3 is a diagrammatic sketch similar to the elevation of FIG. 1 to illustrate the preferred arrangement of the device according to the invention of a circular knitting machine.

FIG. 3 shows diagrammatically that the preferred arrangement of the device according to the invention is disposed on a circular knitting machine at an angle of substantially 45° to the needle axis. For the sake of clarity, FIG. 3 shows only one needle head 23 at the point 22 and the aspherical lens 21 with the optical axis 27.

The functioning of the device according to the invention is described below with reference to FIG. 4.

Figure 4A:
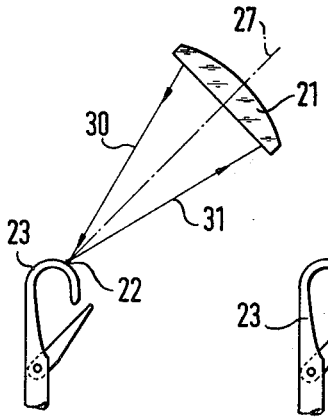
FIG. 4*a*, *b*, *c*, are diagrammatic elevations similar to FIG. 1, illustrating various conditions of operation, or of disturbance, on a circular knitting machine monitored by the device according to the invention.

FIG. 4*a* represents the normal case in which a beam of light 30 coming from the illuminating component falls on the point 22 of a needle head 23 from which the light is directed into the receiving component 25 as a reflected beam 31. Thus it is essential that the optical axis of the lens 21 is perpendicular to the tangential plane at the point 22 of the needle head 23 which has just been sensed.

Figure 4B:
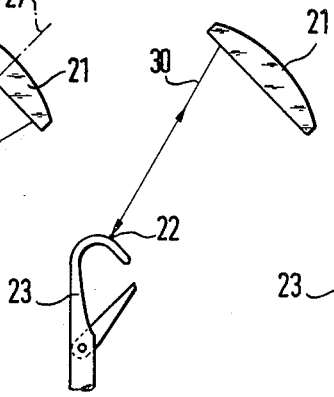

FIG. 4*b* shows a case of a bent needle head 23. It is obvious that the beam of light 30 is reflected back upon itself and so no light reaches the receiving component 25 and therefore the evaluating electronic system emits a warning signal.

Figure 4C:
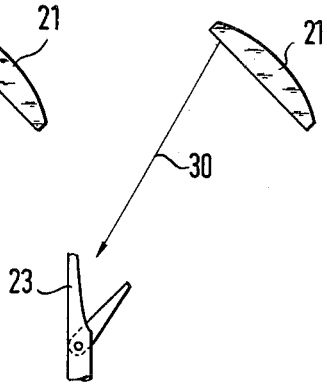

FIG. 4*c* reproduces the case of a broken off needle head 23. In this case the beam of light from the illuminating component 26 is not reflected at all and so the receiving component 25 likewise receives no light and the threshold value electronic system 24 stops the circular knitting machine.

According to the invention the condensing lens 4 has a very short focal length and the lamp 2 is very small so that a high imaging ratio is obtained and the full illumination of the lens 19 is ensured with a relatively small coiled filament (0.3 mm × 0.8 mm). The transmission slit (0.5 mm × 4 mm) is imaged exactly in this way on the hook of the needle head. In accordance with the invention the image is narrower than the needle head 23. This ensures that during sensing no light passes the needle hook to be possibly reflected, from any bright object at the back. The slit is very sharp and long enough to facilitate adjustment.

The receiving component 25 is constructed practically on the same principles as the illuminating component 26.

The receiving diaphragm conveniently has an aspect ratio of 1.2 × 4, all dimensions being given in mm.

The condensing lens 8 in front of the photo-transistor 5, which consists of lenses 7 and 8, is optically constructed so that the image of the lens 20 is smaller than the transistor crystal so that all the light coming into the optical system is picked up. This is important because there is no excess light since the lamp, according to the invention, must be operated with the minimum possible undervoltage. Hence, by means of the arrangement according to the invention, the amount of light available is exploited to the full.

It is important that the transmission slit 10 is also capable of being adapted to the needle size by an exchange of the diaphragm 9.

Since there is a variety of needle thicknesses, the interchangeability of the diaphragm 9 is particularly convenient.

Since, for a special case, both the slit 10 and also the slit 11 have to be adapted individually in size it is particularly convenient for these two important parts, of the optical system to be in the same diaphragm 9 so that the exchange of the two elements can be carried out in a single operation.

Lateral bending of needles can be monitored as follows. As long as the needles are unbent the optical signals come at uniform intervals. When needles are bent laterally these time intervals vary and can be measured with a suitable electronic device.

Furthermore, in accordance with the invention the aspherical front lens 21 is made so as to be interchangeable so that it, too, can be adapted to different distances and optionally also to needle widths of different sizes. It is also important for the main beams between the lenses 19, 20 and 21 to run parallel.

What we claim is:

1. Apparatus for the continuous monitoring of the condition of the needle heads of a circular knitting machine which move past a predetermined point one after the other at a definite frequency, comprising a housing having a tube, an illuminating component and a receiving component disposed side by side in said housing, said illuminating component comprising: a light source, a condensing lens, a slit and focusing lenses for producing a light spot in the form of a line situated in the plane of an illuminated needle head, without light projecting laterally beyond it, said focusing lenses being disposed in the tube and consisting of a semicircular lens occupying substantially half the cross-section of the tube and a round aspherical lens occupying the entire cross-section of the tube disposed behind the semi-circular lens, the focal point of the semi-circular lens lying in said slit, said light spot being projected into an aperture substantially the size of the image of the light spot, a photo-receiver disposed behind said aperture and adapted to emit an electrical pulse signal in proportion to the luminous flux passing through the aperture, and a threshold value electronic device for receiving said signal, which when said signal undergoes a predetermined change is adapted to deliver a warning signal.

2. Apparatus according to claim 1, wherein said predetermined change in said signal comprises a fall in a pulse below a predetermined value.

3. Apparatus according to claim 1, wherein said predetermined change in said signal comprises a change in a predetermined time spacing of two successive pulses.

4. Apparatus according to claim 1, wherein the housing consists of a rectangular box, an end cover and a cylindrical tube.

5. Apparatus according to claim 1, wherein the light source comprises a coiled filament which is imaged in said semi-circular lens.

6. Apparatus according to claim 1, wherein the receiving component comprises said photo-receiver in the form of a photo-transistor, a second aspherical lens, a second slit comprising said aperture, and second focusing lenses which project the linear light spot into the aperture.

7. Apparatus according to claim 6, wherein the second focusing lenses are disposed in the tube and consist of a semi-circular lens which occupies substantially half the cross-section of the tube and the first said aspherical lens, which is disposed in front of this.

8. Apparatus according to claim 7, wherein said semi-circular lenses are constructed in the same way and are disposed in the same cross-sectional plane of the tube.

9. Apparatus according to claim 7, wherein the optical axis of the aspherical lens common to the illuminating and the receiving component lies in the middle between the optical axes of the illuminating and receiving components.

10. Apparatus according to claim 6, wherein the slits of the illuminating and of the receiving components lie parallel in one plane.

11. Apparatus according to claim 10 wherein both slits are formed in an interchangeable diaphragm.

* * * * *